US006016935A

United States Patent [19]

Huegerich et al.

[11] Patent Number: 6,016,935

[45] Date of Patent: Jan. 25, 2000

[54] VISCOUS FOOD DISPENSING AND HEATING/COOLING ASSEMBLY AND METHOD

[75] Inventors: Michael Lee Huegerich, St. Louis; Thomas Hunot, Bridgeton, both of Mo.

[73] Assignee: Star Manufacturing International, Inc., St. Louis, Mo.

[21] Appl. No.: 09/127,616

[22] Filed: Aug. 1, 1998

[51] Int. Cl.[7] ..... B67D 5/62

[52] U.S. Cl. ..... 222/146.1; 222/214

[58] Field of Search ..... 222/146.1, 214, 222/105

[56] References Cited

U.S. PATENT DOCUMENTS

| | | |
|---|---|---|
| D. 141,362 | 5/1945 | Elkins . |
| D. 215,045 | 8/1969 | Benjamin . |
| D. 220,303 | 3/1971 | Gran . |
| D. 246,310 | 11/1977 | Syverson et al. . |
| D. 251,564 | 4/1979 | MacKrell . |
| D. 274,779 | 7/1984 | LaLumlere . |
| D. 287,690 | 1/1987 | Steinkamp . |
| D. 328,220 | 7/1992 | Barnard et al. . |
| D. 365,962 | 1/1996 | Amundsen et al. . |
| 1,307,478 | 6/1919 | Berdahl . |
| 1,554,855 | 9/1925 | Johnson et al. . |
| 2,022,208 | 11/1935 | Lacke . |
| 2,102,837 | 12/1937 | Davis . |
| 2,205,875 | 6/1940 | Coffey et al. . |
| 2,662,256 | 12/1953 | Gagne . |
| 2,681,009 | 6/1954 | Titus . |
| 2,765,963 | 10/1956 | Langguth . |
| 2,811,284 | 10/1957 | Rogers . |
| 2,818,028 | 12/1957 | Berman . |
| 2,837,246 | 6/1958 | Steele . |
| 3,106,320 | 10/1963 | Campbell et al. . |
| 3,191,807 | 6/1965 | Rodrigues, Jr. . |
| 3,212,681 | 10/1965 | Weikert . |
| 3,297,206 | 1/1967 | Scholle . |
| 3,317,141 | 5/1967 | Mann . |
| 3,332,585 | 7/1967 | Cox . |
| 3,452,901 | 7/1969 | Roach . |
| 3,520,451 | 7/1970 | Ashizawa . |
| 3,777,943 | 12/1973 | Spauling et al. . |
| 4,094,446 | 6/1978 | Brutsman . |
| 4,228,925 | 10/1980 | Mendelovich . |
| 4,474,214 | 10/1984 | Iannelli . |

(List continued on next page.)

FOREIGN PATENT DOCUMENTS

| | | |
|---|---|---|
| 516855 | 1/1940 | United Kingdom . |
| 688150 | 3/1953 | United Kingdom . |

OTHER PUBLICATIONS

Liqui–Box Announces . . . Liqui Box Corporation (Publication date unknown).

Flurry Topping Food Dispensers; Bulletin XOWMDP001; Flurry International Inc., 1990.

Ultra Fast Drink Maker House Beautiful, Apr. 1974, p. 38.

Hot Product Dispenser Food Service Equipment & Supplies Specialist, Jan. 1988, p. 100.

Remcor Dispenser (TJ–45), Restaurants & Institutions, Spring, 1988.

*Primary Examiner*—Philippe Derakshani

*Attorney, Agent, or Firm*—Polster, Lieder, Woodruff & Lucchesi

[57] ABSTRACT

This invention relates to assemblies for pumping from a container, dispensing and heating or cooling edible viscous food products having the viscosity of ketchup, mustard, melted cheese, sour cream, salsa or the like. More specifically, the invention relates to peristaltic pumping and dispensing assembly with housing and heating/cooling flow channels for dispensing food products with such viscosity.

25 Claims, 10 Drawing Sheets

U.S. PATENT DOCUMENTS 4,513,885 4/1985 Hogan .
4,544,085 10/1985 Frazer .
4,651,898 3/1987 Bell .
4,690,307 9/1987 Hogan .
4,717,047 1/1988 van Overbruggen et al. .
4,756,450 7/1988 Negaty-Hindi et al. .
4,796,788 1/1989 Bond .
4,869,404 9/1989 Elliott .
4,941,597 7/1990 Lopez et al. .
5,000,351 3/1991 Rudick .
5,040,700 8/1991 Compton .
5,069,364 12/1991 McGill .
5,102,015 4/1992 Barnard et al. .
5,121,677 6/1992 Le Claire et al. .
5,142,610 8/1992 Augustine et al. .
5,169,292 12/1992 Loubier et al. .
5,241,899 9/1993 Kuhlman .
5,249,706 10/1993 Szabo .
5,285,815 2/1994 Henry et al. .
5,297,945 3/1994 Loubier et al. .
5,349,825 9/1994 Duke et al. .
5,353,963 10/1994 Gorski et al. .
5,365,831 11/1994 Kuhlman .
5,366,308 11/1994 Crispino .
5,375,746 12/1994 Schaefer et al. .
5,381,932 1/1995 Humphrey .
5,419,238 5/1995 Pinone .
5,462,210 10/1995 Kuhlman .
5,531,156 7/1996 Brummett .
5,553,740 9/1996 King et al. .
5,579,959 12/1996 Bennett et al. .
5,759,599 6/1998 Wampler et al. .
5,799,832 9/1998 Mayo .
5,803,317 9/1998 Wheeler .
5,803,377 9/1998 Farrell .
5,875,930 3/1999 Nakajima et al. ..... 222/214

VISCOUS FOOD DISPENSING AND HEATING/COOLING ASSEMBLY AND METHOD

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to assemblies for pumping from a container, dispensing and heating or cooling edible viscous food products having the viscosity of ketchup, mustard, melted cheese, sour cream, salsa or the like. More specifically, the invention relates to a peristaltic pumping and dispensing assembly with housing and heating/cooling flow channels for dispensing food products with such viscosity.

In the prior art, viscous food products of the viscosity of ketchup, mustard, melted cheese and the like, have been heated and dispensed from containers by pumping assemblies. Assemblies such as that in U.S. Pat. No. 5,579,959, use a pumping chamber and dispensing chamber with first and second valves associated therewith wherein the pump action draws the viscous food product into the pumping chamber during an intake stroke and forces the viscous food product through a spout tube during compression pumping action.

In the prior art, dispensers using peristaltic pumps have been employed to dispense viscous food products, as for example, disclosed in U.S. Pat. Nos. 4,513,885 and 4,690,307. In both said patents peristaltic pumps are used to force viscous food product from a container through a discharge tube. A pivotally mounted cam plate is used to hold the discharge tube in position against the rollers of the peristaltic pump rotor. The cam plate can be placed in an open or unlocked position so that the discharge tube can be positioned adjacent the rollers of the rotor. The cam plate can then be moved to a closed position and locked such as by a lock pin to press the discharge tube firmly against the rollers of the rotor. In this locked position, an operating handle is pivoted to rotate the rotor and its rollers so that pressure of the rollers against the discharge tube forces viscous food product from the container through the discharge tube and out a discharge fitment. However, the cam plates in those patents are held rigidly in fixed position and do not allow play between the cam plate and the discharge tube. As a result, the force against the discharge tube can be too tight to either block or overly impair flow therethrough, or on the other hand be too loose so that the viscous food drips. Further, for devices in which the position of a cam plate is fixed relative to the rollers, when different size discharge tubes are used, there will be a variance in the amount of force applied by the rollers against the tube during pumping. This also can cause blocking or over impairment of flow, or excessive flow and dripping. There is thus a need for a device wherein an approximately constant force can be applied to a discharge tube used with a peristaltic pump for discharging viscous food products at a proper flow rate.

With heated viscous food products, it is important that the product, such as melted cheese, be maintained at certain sanitary temperatures so that bacteria growth will be impaired and the food will be safe to eat. With a peristaltic pumping arrangement, it is, therefore important and desirable, to have a heating system which not only heats the food in the container, but which also heats the discharge tube and the discharge outlet so that bacteria growth is impaired in those areas as well.

BRIEF SUMMARY OF THE INVENTION

The present invention overcomes prior art problems and provides a number of advantages for dispensing viscous food products having the viscosity of ketchup, mustard, melted cheese, sour cream, salsa or the like. The invention can be used with a reservoir of viscous food such as a bag of viscous cheese to dispense the viscous food through a discharge tube. The assembly of the present invention provides a peristaltic pump having peristaltic pressure members, mounted for rotational movement relative to a housing. The housing can have a support for a reservoir of viscous food.

The invention has means for applying force to the discharge tube against the pressure members of the peristaltic pump. This means includes a compression member, which in the preferred embodiment is a block movably mounted relative to the housing and to the pump rotor. The discharge tube can be positioned between the compression member and the pressure members of the pump rotor. The compression member can be spaced from the pump pressure members to allow the discharge tube to be placed between the peristaltic pressure members and the block. The compression member can then be moved next to the discharge tube. The force applying means also includes a means for biasing the compression member. The biasing means allows the compression member to be moved away from the pump pressure member to install the discharge tube. The biasing means is engaged to force the compression member against the discharge tube to press the tube against the rotating pressure members of the peristaltic pump, to thus provide peristaltic pumping action of the viscous food through the tube. The biasing means enables the compression member to apply pressure against the discharge tube for different positions of the pressure members during pump operation. Moreover, the biasing means allows for different size discharge tubes to be used interchangeably, with a comfortable amount of pressure that allows sufficient flow through the discharge tube, but also is not so loose as to allow excessive flow or dripping. Further, the biasing means allows for greater variation in the tolerances for components associated with the means for applying force to the discharge tube, as the force applied by the biasing means can make up for variations in the size of components. The play allowed by the biasing means thus allows the components such as the compression member, the peristaltic pump head and pressure members, and the mounting means for the compression member, to be machined with more tolerance for variation. This provides advantages over prior art units that have the force applying member held in a fixed position, such as in the said U.S. Pat. Nos. 4,513,885 and 4,690,307.

In the preferred embodiment wherein the biasing means comprises a torsion spring component, one part of the torsion spring can rest against the compression block while another part can be moved to an engaged or latched position, so that the spring presses the block with an approximate constant pressure. In the preferred embodiment, a catch for engaging the spring can be assembled with the housing.

In the preferred embodiment the biasing means and the compression member, as well as the pump head, are assembled so as to be easily detached from the housing. This allows the components to be cleaned to remove any food or other substances that have gathered on the components. The assembly unit can thus be quickly and easily cleaned.

Preferably, the support for the reservoir of viscous food is located above the pump head so that the discharge tube can extend downwardly from the reservoir alongside the pump head for engagement with the compression member during operation.

The invention also can be provided with a heating source, or a cooling source, and forced convection of heated or cooled air within the housing. In the case of being provided with a heating source, forced convection of heat occurs within the housing. The heat can be important in not only keeping the viscous food such as melted cheese or viscous chili at a desired temperature for eating, but also in resisting bacteria growth. The assembly has structure that creates flow paths for heating the viscous food at various points as the food rests in a reservoir, is located within the discharge tube, and the distal tube end. The assembly can provide flow paths so that heat can flow by convection about the reservoir of viscous food product to heat the viscous food and keep it at a desired temperature. In a preferred embodiment such flow can be along the bottom, sides, front and top of the reservoir. Also in preferred embodiments, the forced convection flow paths take advantage of natural convection characteristics.

In a preferred embodiment a tube cover can be associated with the housing. The tube cover can be movably mounted relative to the housing so that the end portion of the discharge tube is within the tube cover. The passageways of the housing and tube cover form a flow path which allows heat from the heat source to flow through the tube cover to heat the viscous food product at the discharge tube end to a desired temperature to resist bacteria growth.

Flow paths are also provided so that heat from the heat source flows about the portion of the discharge tube in the vicinity of the pump rotor, and the discharge tube. In a preferred embodiment this area can be generally above the tube cover to extend near the connection of the discharge tube to the viscous food reservoir.

Flow paths can further be provided along the bottom and sides of the support for the viscous food reservoir. In a preferred embodiment, flow space is provided between the housing walls and walls associated with the reservoir, so that the flow ultimately reaches the top of the reservoir and food product.

These same flow paths can be used for forced convection flow of cooled air through the flow paths about viscous food, such as viscous ice cream.

The assembly also provides a flow path for the return of the heated air, or cooled air, that has circulated about the tube cover, discharge tube and the food container. Multiple peristaltic pump arrangements with force applying means and multiple food product reservoirs, can be provided with a single housing structure.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

Figure 1:
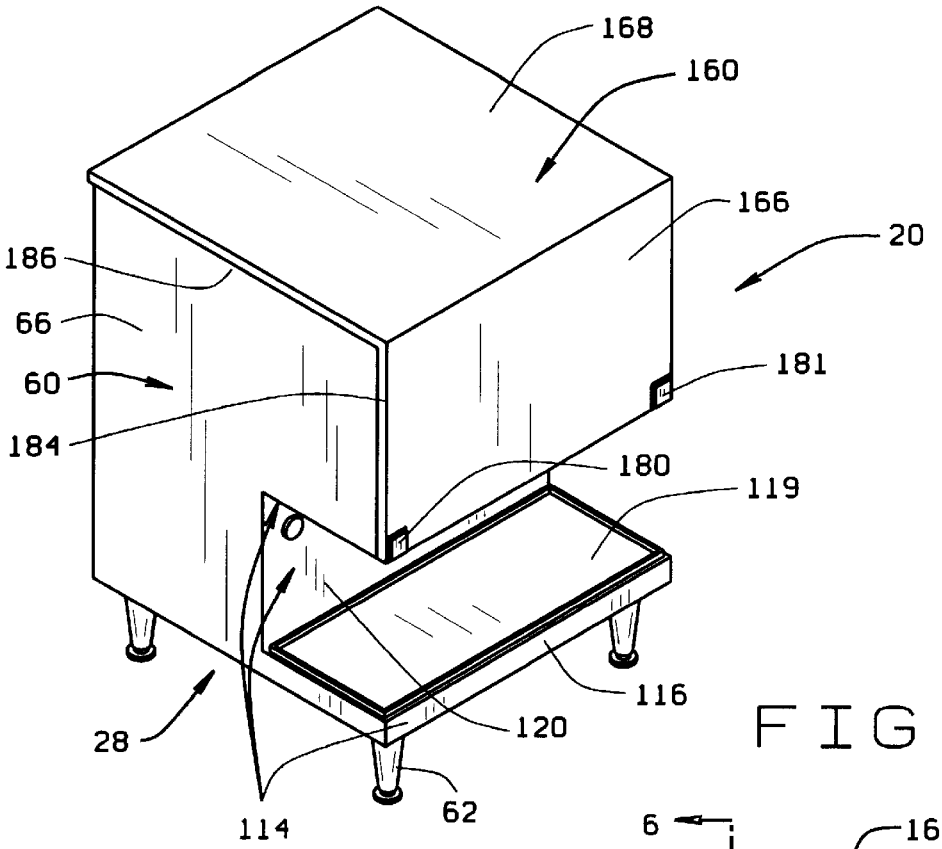
FIG. 1 is a orthogonal projection of the assembly of the invention.
Figure 2:
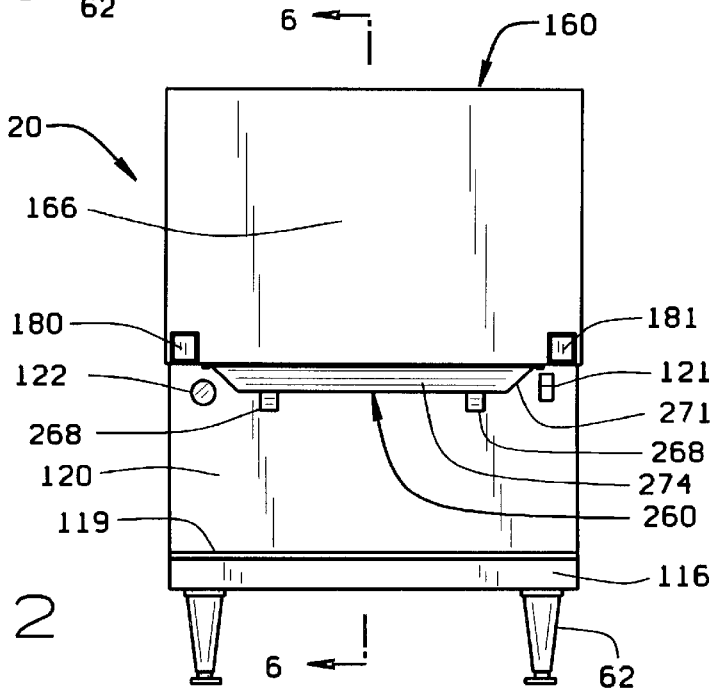
FIG. 2 is a front elevation of the assembly of FIG. 1.
Figure 3:
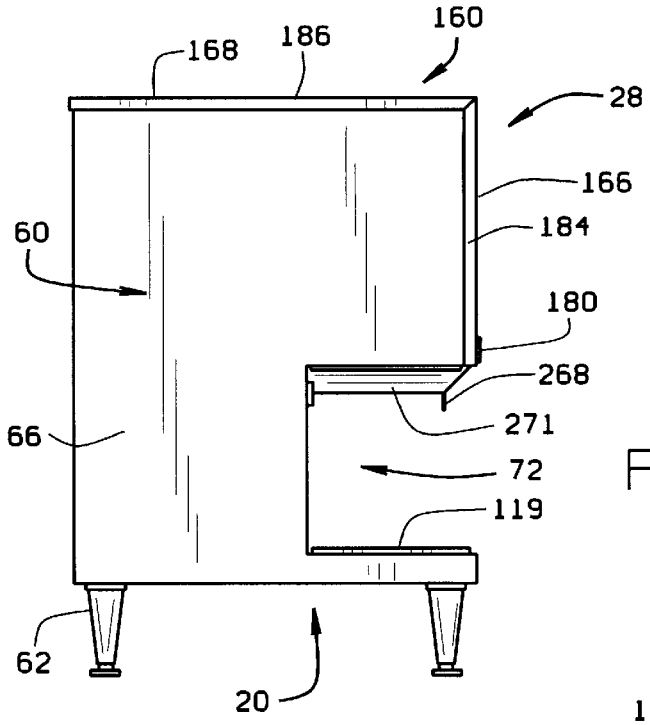
FIG. 3 is a side elevation of the assembly of FIG. 1.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Overall General Description

First an overall general description will be given. With reference to the drawings, the assembly for dispensing and heating viscous food products is generally designated 20. A description of the assembly 20 will be given in connection with a reservoir 22 of viscous food, illustrated in FIG. 5 as a bag containing viscous food, with the bag being connected to a discharge tube 24. In general, the assembly 20 comprises a main housing 28 and a means 30 for supporting the reservoir 22 of viscous food product. Assembly 20 further comprises a peristaltic pump subassembly 32 having pressure members 35 for pumping viscous food through discharge tube 24. Assembly 20 moreover comprises means 38 for applying force against the discharge tube 24 to press it against pump pressure members 35. The force applying means 38 generally comprises a compression member exemplified by a block 42 movably mounted relative to the peristaltic pump subassembly 32, and means 46 for biasing the compression member 42 against the tube 28 comprising a spring assembly 48 (see in particular FIGS. 8 and 9).

The assembly 20 moreover comprises a means 51 for controlling the temperature of air circulated throughout the assembly 20. In the illustrated embodiment, the means 51 comprises an electrical heating element 52. Alternatively, the means 51 could be a refrigeration unit for cooling the air to be circulated about the viscous food. The assembly 20 further comprises a means 54 for providing forced circulation of temperature regulated air for controlling the temperature of the viscous food. In the illustrated embodiment, with the heating element 52, the forced circulation is forced convection of heat, and the forced circulation of air means 54 comprises a fan and motor assembly 57, and flow channels as will be later described, for distributing heated air about the discharge tube 24 and the viscous food reservoir 22 and back to the fan/motor assembly 57.

Detailed Description Of Preferred Embodiments

Now, turning to a more detailed description, the main housing 28 of assembly 20 is depicted in FIGS. 1–7 and 10. The main housing 28 comprises a box like section 60 supported by four legs 62 are secured. Box section 60 has a bottom floor wall 64 (FIGS. 5–6) to which the legs 62 are secured as by screws. Box 60 further has a pair of side walls 66 and 68 each of which have lower horizontal flanges (not shown) secured to the floor wall 64 as by screws. Each of the side walls 66 and 68 have a "C"-shaped front opening which provides the front of the box section 60 with a generally rectangular recess 72.

Figure 5:
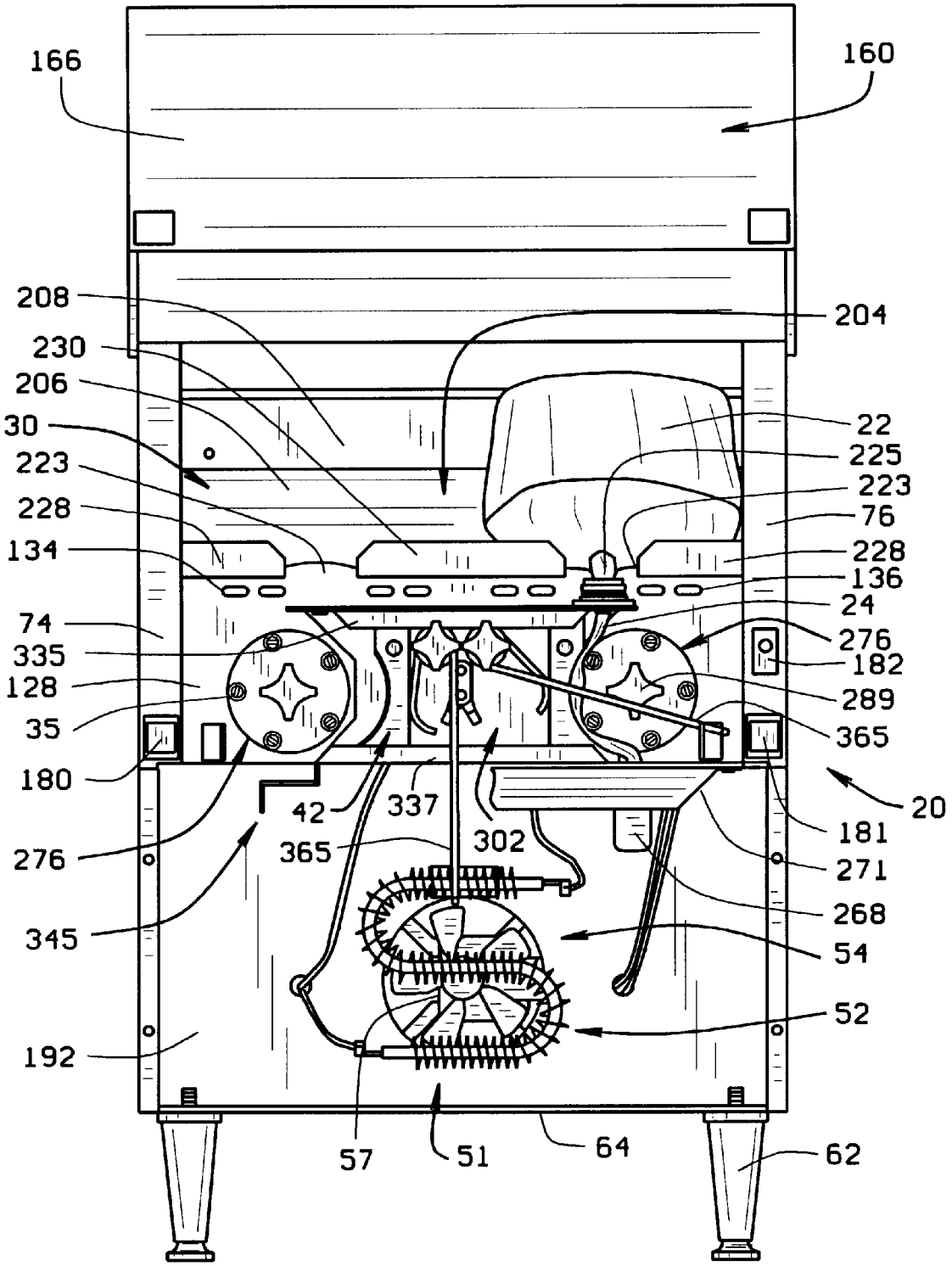
FIG. 5 is a front elevation of the assembly, with the top cover shown open, with one viscous food container shown installed on the reservoir mounting support; with the biasing means including a torsion spring shown in the engaged position to the right side of FIG. 5, and in the disengaged position on the left side of FIG. 5, and with part of the lower part of the housing shown exposed for a better view of the fan and heating element.
Figure 11:
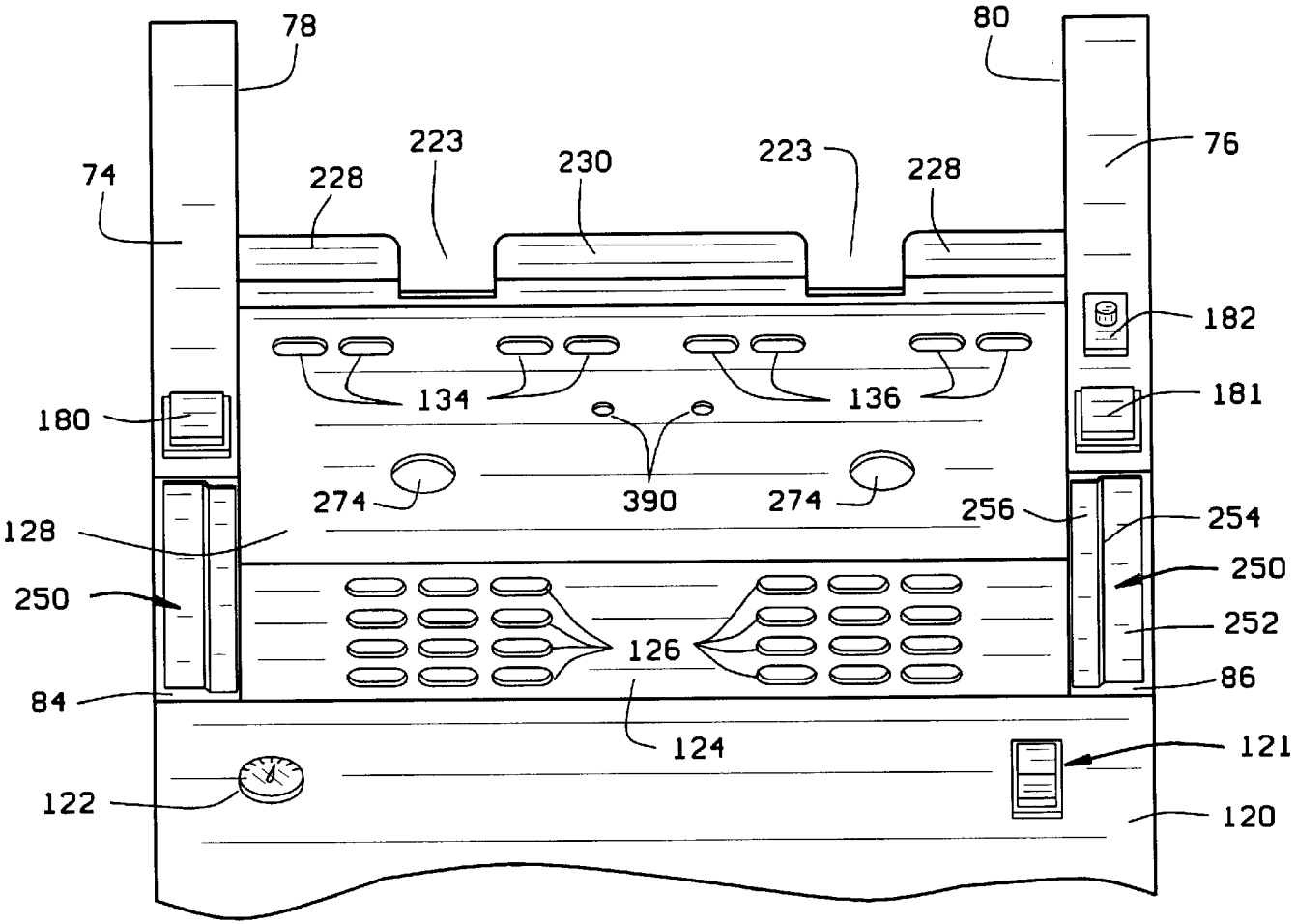
FIG. 11 is an angled view of the front side of the assembly, but with the tube cover removed, showing in particular the ventilation and circulation openings through the wall above the tube cover, and through the pump head support strut, and showing the front lip walls of the reservoir support.

At their front upper edges, each of the side walls 66 and 68 have inwardly projecting front wall sections 74 and 76 that project into rearward flanges 78 and 80 that are parallel to the side walls 66 and 68. The side walls 66 and 68 have inwardly extending flanges 84 and 86 that extend rearwardly beyond the bottom of front wall sections 74 and 76. Inwardly from the upper edge of each side wall 66 and 68 extend. horizontal top walls (not shown) that depend downwardly at their inner ends into flanges (not shown). As seen in FIGS. 5 and 11, there is an open space between each of the front walls 74 and 76.

Box section 60 has a rear wall 94 with a bottom flange that is secured to the floor wall 64 as by screws. The sides of rear wall 94 are secured as by screws to flanges (not shown) that extend inwardly from the rear edges of the side walls 66 and 68.

A pair of flat vertical side insulation walls 98 and 100 are positioned slightly inwardly from each of the corresponding side walls 66 and 68, respectively. Inwardly extending from the upper edge of each of the insulation walls 98 and 100 are horizontal flanges (not shown) that extend upwardly into vertical flanges (not shown), that are secured to the inside flanges at the top of the side walls 66 and 68, as by rivets (not shown). Each of the side insulation walls 98 and 100 have flanges 110 and 111 extending outwardly from their rear edges which are secured to rear wall 76 as by screws. The bottom edges of side insulation walls 98 and 100 have outwardly extending flanges (not shown) secured to floor wall 64 as by screws.

Towards the front of box section 60 is an integral arrangement of walls formed from a single stamped and punched sheet 114, such as of stainless steel. The sheet 114 comprises a lower front wall 116 that has a lower horizontal flange secured to the floor wall 64 as by screws. The sheet 114 then extends rearwardly from wall into a horizontal drip tray support wall 118, upon which a drip tray 119 can be removably mounted. From wall 118 sheet 114 thence extends vertically into a wall 120 upon which is mounted an on/off power switch 121 and a thermometer 122. Sheet 114 extends from the top of wall 120 into a horizontal wall 124. As seen in FIG. 11, wall 124 has a plurality of vent port openings 126 arranged on either side for flow of forced convection heat to be later described. From the front end of wall 124, sheet 114 extends into a transverse strut wall 128. At the top of strut wall 128, the sheet 114 extends rearwardly into a short horizontal flange 132. Strut wall 128, as seen in particular in FIGS. 5 and 11, has upper pairs of port openings 134 and 136 located on either side of notches in the reservoir means 30, as will be described. The ports 126, 134 and 136 are part of forced convection heat flow paths to be later described. Wall 128 comprises a strut for mounting a pump head with the pressure members 35, as well as for mounting the means 38 for applying force, including the compression member 42 and the biasing means 46, as will be described.

To the rear of the vertical wall 120 is a vertical insulation wall 148 having side flanges 152 that are secured to the side insulation walls 98 and 100 as by rivets, and at its upper end has a horizontal wall 154 that abuts the top of wall 120. The insulation wall 148 is spaced from wall 120 so as to provide an insulation space between insulation wall 148 and wall 120 as well as wall 116 and wall 118 and part of floor wall 64.

Figure 4:
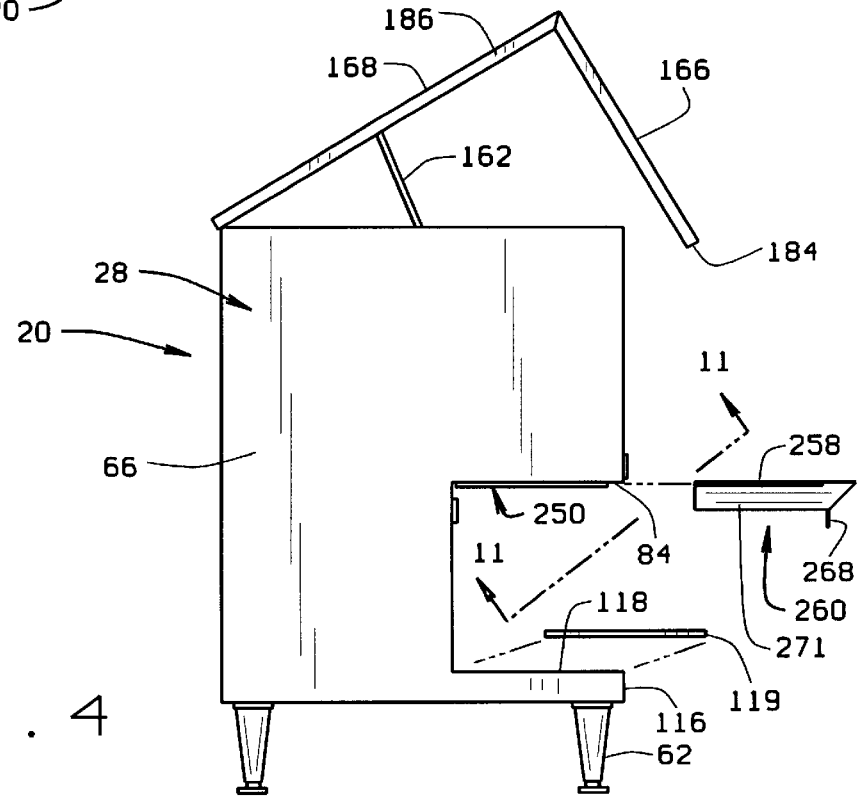
FIG. 4 is a side elevation of the housing as in FIG. 3, except the top cover is pivoted to an open position, and the tube cover and drip tray are shown exploded.
Figure 6:
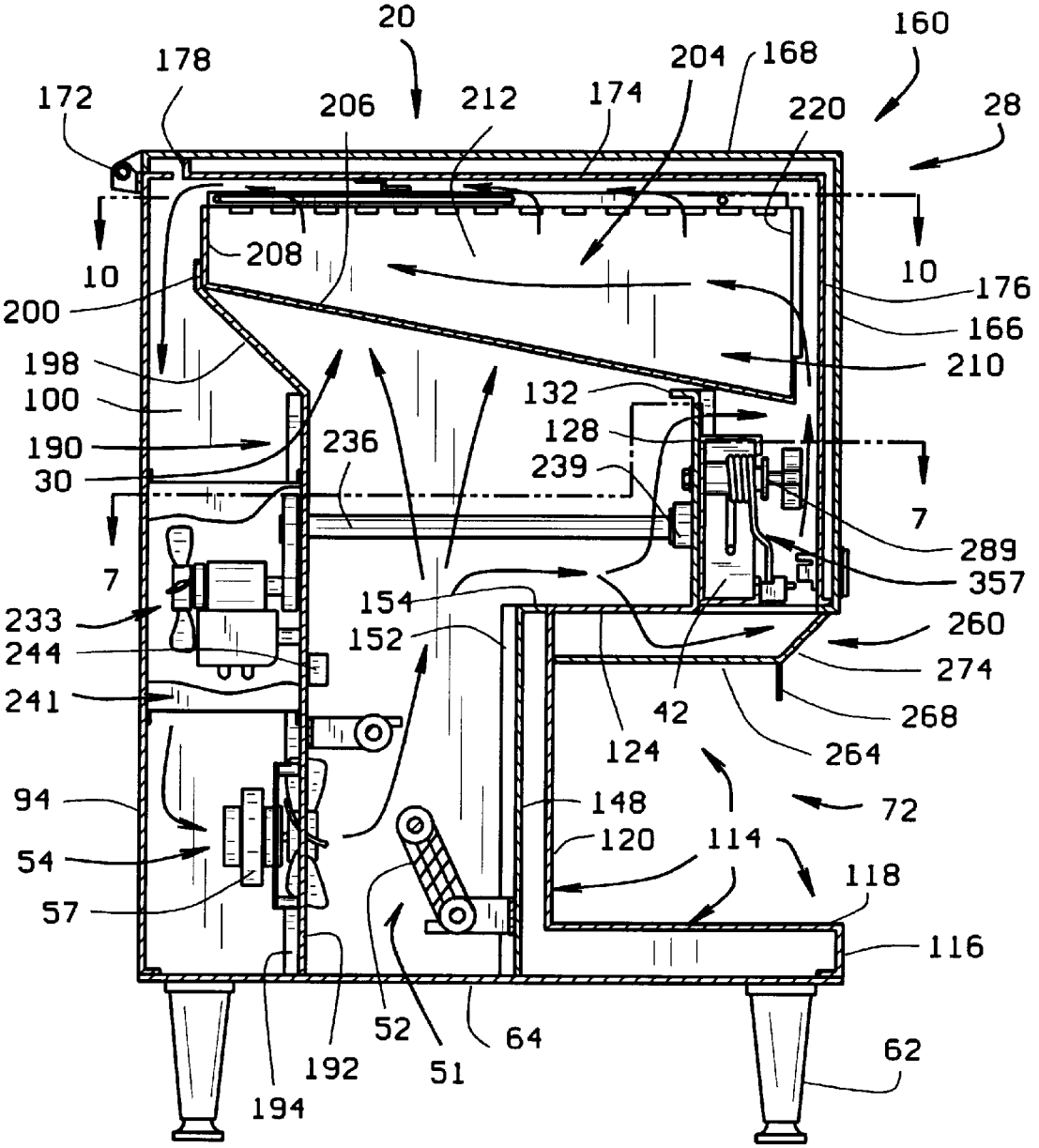
FIG. 6 is a section of the assembly taken on the line 6—6 of FIG. 2, with forced convection flow paths being indicated with arrows.

At the upper end of the box section 60 is a pivotable cover 160. As seen in FIGS. 4 and 5, cover 160 can be pivoted to an open position and held open by a U-shaped support rod 162 which is pivotally engaged at its U-shaped ends 164 to the insulation walls 98 and 100. The cover 160 has a flat front wall 166 which bends rearwardly at its upper end into an integral top wall 168. When the cover 160 is closed, the front wall 166 is vertically oriented and the top wall 168 extends horizontally. The rear end of the cover top wall has a downward extending flange which is connected as by hinges 172 to the back of rear wall 94, to thus allow the cover 160 to pivot from an open to a closed position. As seen in FIG. 6, to the inside of the cover 160 is an L-shaped insulation wall having a top wall section 174 that extends into a vertical wall 176. The inside of insulation wall 174 has a bracket secured to it (not shown) for the top bar of support rod 162. Insulation wall section 174 has a vertical flange 178 extending from its rear edge to abut the underside of cover wall 168. The vertical wall 176 extends against a front flange at the bottom of front cover wall 166. The side edges of cover insulation wall sections 174 and 176 have L-shaped flanges (not shown) which are secured to the inside of top-cover wall 168 and front cover wall 166 as by spot welding.

The cover front wall 166 has rectangular notches at its lower ends so that when cover 160 is closed, access is provided to pump switches 180 and 181 that are mounted near the bottom of front wall sections 74 and 76. A safety switch 182 is also mounted to the front wall section 76. The side edges of the front cover wall 166 and top cover wall 168 are flanged at 184 and 186 to extend to the outside of the side walls 66 and 68 as seen in FIG. 1, and thus help prevent the escape of heat.

Inside box section 60 is a motor support wall 190. As seen in FIG. 6, wall 190 has a lower vertical wall section 192, which has at each of its side edges flanges 194 that are secured to side insulation walls 98 and 100 as by rivets. Wall section 192 extends upwardly into an angled wall section 198, which then extends upwardly into a vertical upper end wall 200.

Figure 13:
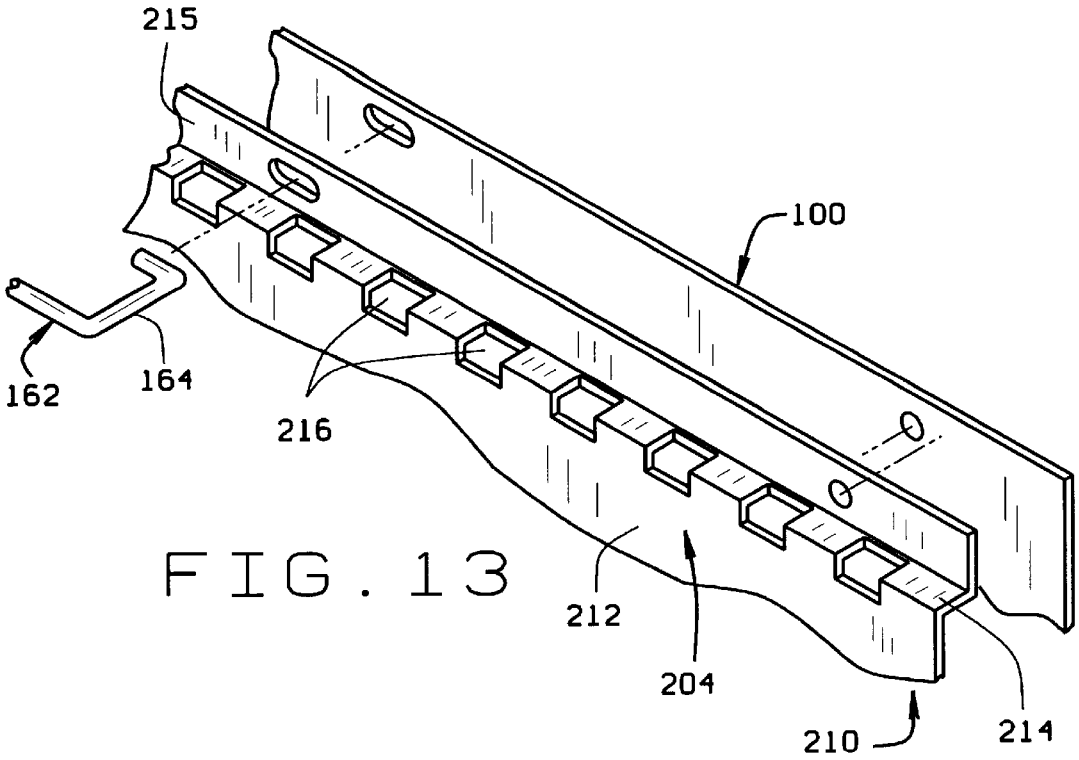
FIG. 13 is an enlarged exploded view of the upper part of one of the reservoir support side walls and a side insulation wall and cover pivot rod.
Figure 14:
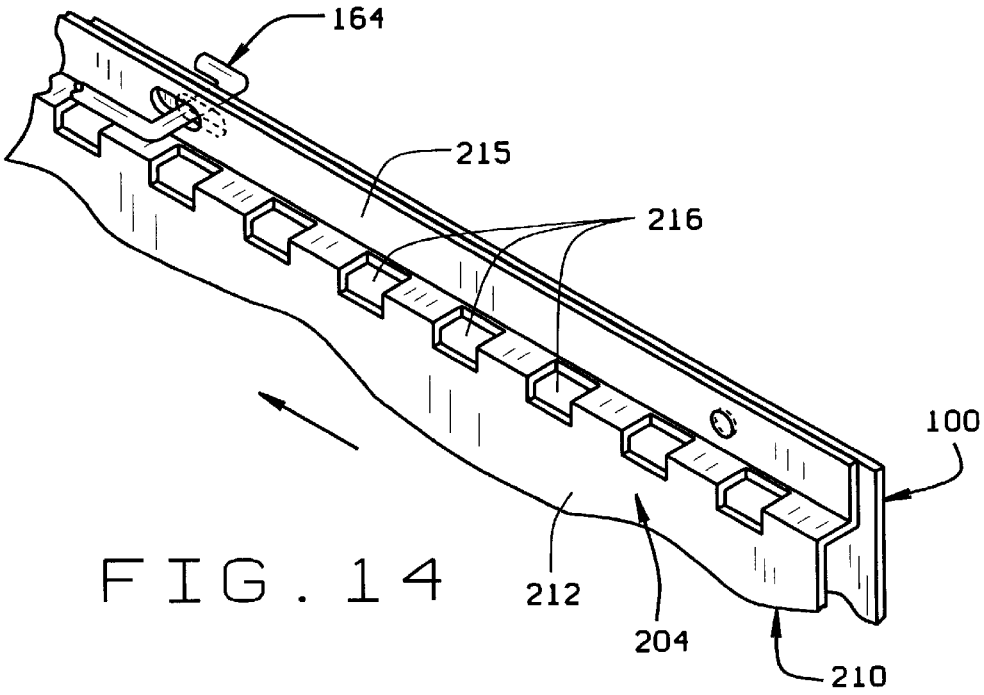
FIG. 14 is an enlarged view of the components of FIG. 13 in an assembled position, showing part a reservoir support side wall mounted to part of an insulation side wall, with the cover pivot rod installed.
Figure 15:
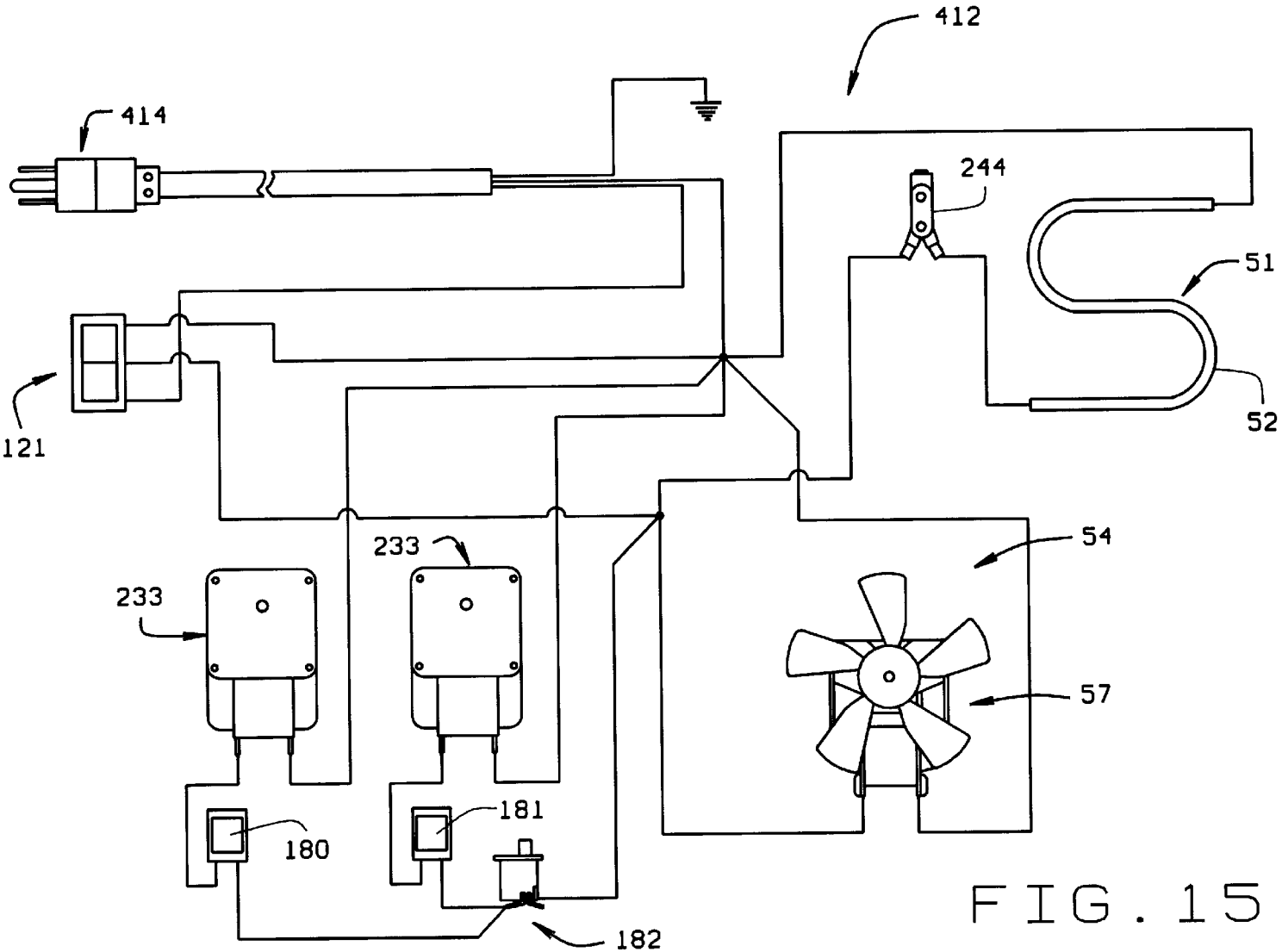
FIG. 15 is a schematic of the electrical circuit for the assembly.

The means 30 for supporting the viscous food reservoir 22 comprises a support 204 located within the box section 60. Support 204 has a general trapezoidal shape, with a slanted floor wall 206. From the rear of support floor 206 extends a rear vertical wall 208 that is secured as by screws to the upper motor mount wall section 200. As shown more particularly in FIGS. 6 and 10, the reservoir support 204 has side walls 210. Each reservoir side wall 210 has a vertical lower section 212 that extends integrally from floor wall 206. Each side wall section 212 then extends into a horizontal wall section 214, which thence extends into vertical flanges 215 (FIGS. 13 and 14) that are secured to the insulation walls 98 and 100 as by screws. Each of the horizontal wall sections 214 and the top of the reservoir side wall sections 212 have a plurality of spaced contiguous holes 216 which allow flow of heated air therethrough to heat viscous food in reservoir 22. The vertical flanges 215 and the tops of insulation walls 98 and 100 have holes to receive the support rod ends 164. The front edges of support side wall sections 212 have "L" shaped flanges 220 (FIG. 6) secured to insulation walls 98 and 100 as by rivets. As seen more particularly in FIGS. 5 and 10, at the front of support floor wall 206 are a pair of arcuate notches 223 each of which has a front entrance with straight edges that extend into a semicircular inner edge. Each notch 223 is sized to allow passage of reservoir discharge outlets 225. At its front end, the support floor 206 bends upwardly into a pair of outer vertical retainer plates 228 located to the outside of the notches 223, and a middle retainer plate 230 positioned between notches 223. The front of the reservoir bag 22 abuts the retainer plates 228 and 230 to be retained by the reservoir support 204.

Figure 7:
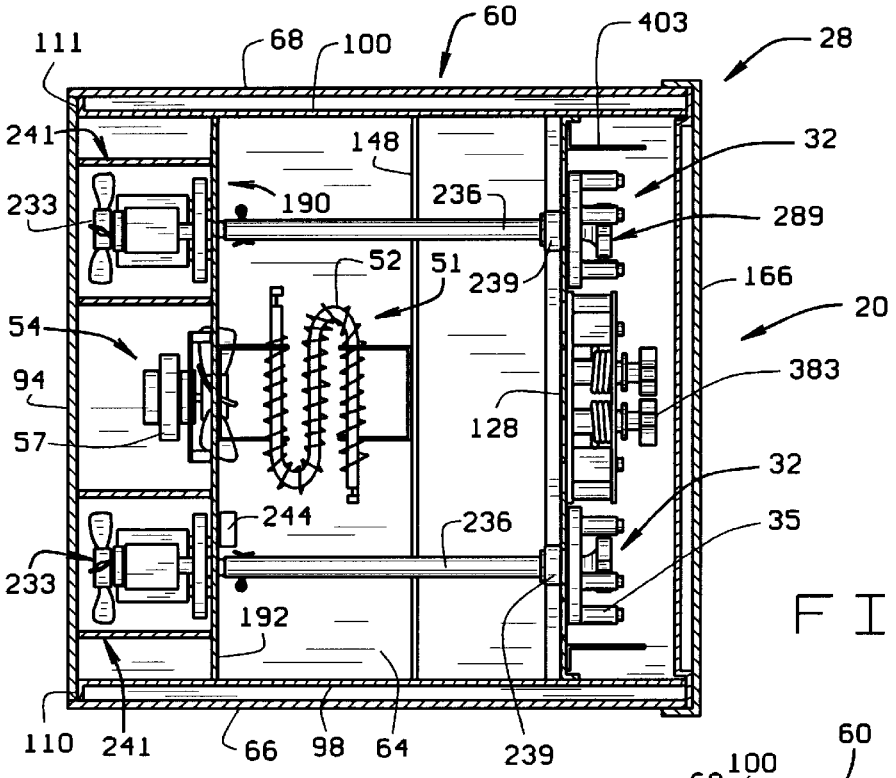
FIG. 7 is a section taken on the line 7—7 of FIG. 6 with the long leg of spring not shown.
Figure 10:
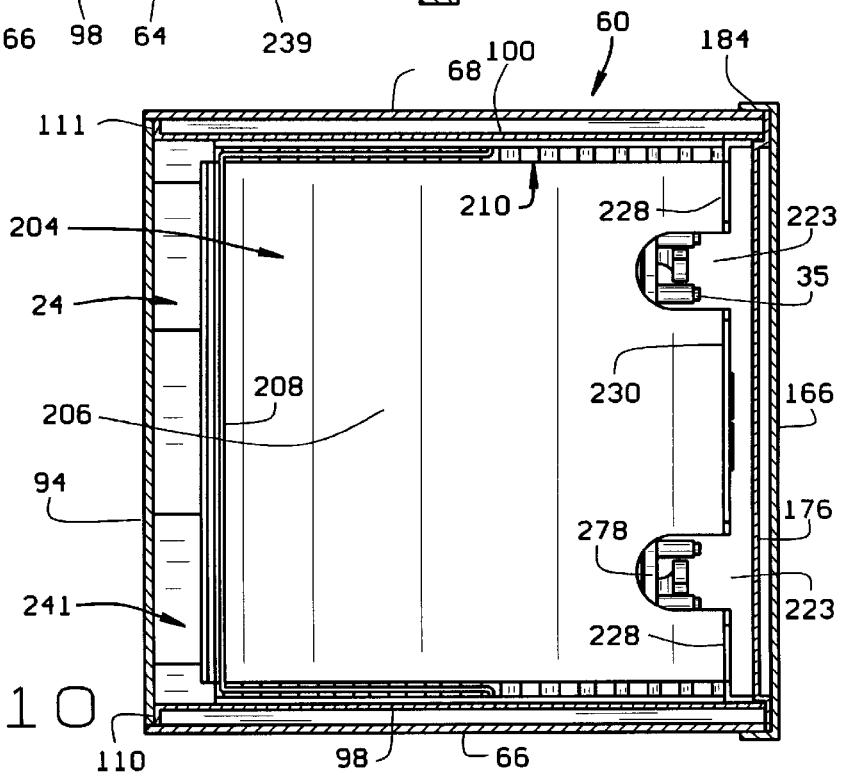
FIG. 10 is a section taken on the line 10—10 of FIG. 6, with the track for the compression block not shown.

The fan and motor unit 57 is mounted in alignment with a duct opening in the motor mount wall 192, as seen in particular in FIGS. 6 and 7. Also as seen in FIGS. 6 and 7, to the sides of box 60, a pair of pump motor assemblies 233 are mounted to the rear side of the motor mount wall section 192. The assemblies 233 are drivingly connected to drive shafts 236 that extend through bearings 239 that are mounted to the rear side of strut wall 128. Each of the pump motor assemblies 233 are encased by a rectangular walled insulation casing 241 which can be comprised of two separate L-shaped members with flanges secured to rear wall 64 and motor mount wall 192 as by screws (FIGS. 6 and 7).

The electrical heating element 52 is mounted as by brackets to the motor mount wall 192 and to the front insulation wall 148 toward the front of circulation fan assembly 57. A thermostat 244 is mounted to the front side of wall 192 and positioned above the fan assembly 57 and the heating element 52.

The side wall flanges 84 and 86 along the upper bounds of housing recess 72 each have a tube cover support bracket 250 attached thereto. Each bracket 250 has a horizontal flat plate 252 secured to the flanges 84 and 86 as by screws. Each plate 252 bends vertically downward at 254 and thence extends into a horizontal ledge section 256. Ledge 256 that is spaced from the flanges 84 and 86 to provide a space therebetween to receive the flat outer lip 258 of a tube cover 260.

The tube cover 260 is detachable from the brackets 250 and box section 60, as seen in FIG. 4. Tube cover 260 also comprises a flat horizontal lower wall 264 that has a pair of square openings 266 with flat vertical grip tabs 268 press stamped to depend from the front edge of the openings 266. The tube cover 260 has outwardly angled side walls 271 which extend at their upper ends into the horizontal lips 258. From the front of the lower tube cover wall 264 extends a trapezoidal shaped front wall 274 that is secured at its ends to the front ends of side walls 271 as by angled brackets. The rear edge of tube cover lower wall 264 can have an upwardly extending flange (not shown) that abuts the front of housing wall 120 when the cover 260 is mounted. The tube cover openings 266 are positioned so that viscous food dispensed through the discharge tube 24 passes therethrough on to a plate or food container as will be described.

Figure 8:
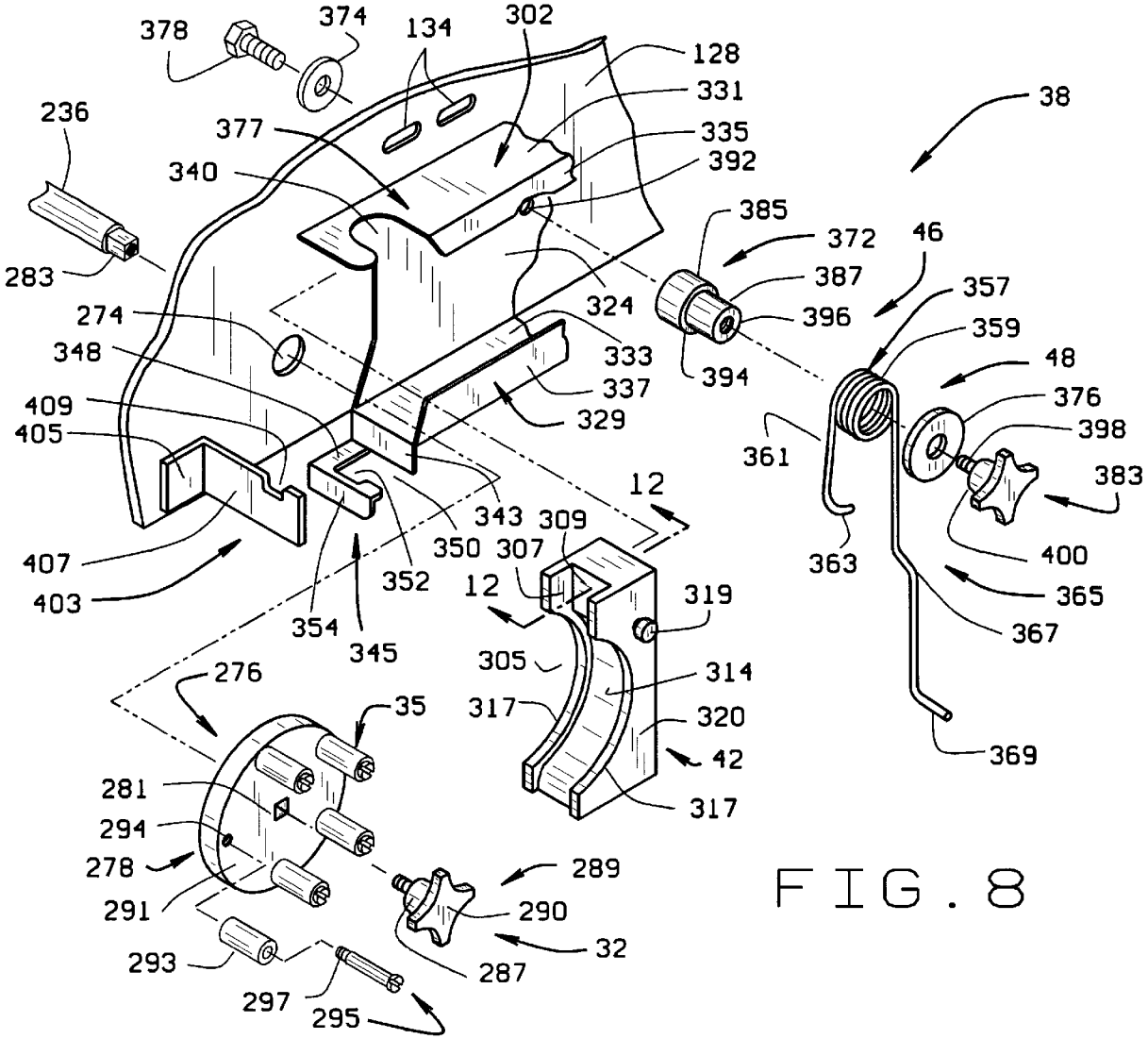
FIG. 8 is an enlarged exploded view of part of the assembly of the invention, and in particular showing the means for applying force against the discharge tube to press it against the pressure members of the peristaltic pump.

As seen in FIG. 8, the pump motor drive shafts 236 extend through holes 274 in strut wall 128 to be connected to a pair of peristaltic pump heads 276. Each pump head 276 comprises a cylindrically shaped disk 278. Each disk 278 has a central square opening 281 which telescopically receives a drive key 283 at the distal end of each drive shaft 236. The end of shaft key 283 has a threaded bore which receives the end of a screw shaft 285 that is press fit into a corresponding opening of a cylindrical sleeve 287 of a hand turnable knob 289. Knob 289 can be of plastic such as phenolic, and has a star shaped grip section 290 that integrally extends into sleeve 287. Each knob 289 can be turned so that the flat end of its sleeve 287 presses against the flat front disk face 291 to hold the disk 278 to shaft 236 to rotate therewith (see FIG. 9).

For each pump head 276, the plurality of peristaltic pressure members 35 are secured to each disk front face 291. Each pressure member 35 comprises a sleeve 293 which can be of plastic such as nylon. Each sleeve 293 is rotatably mounted about a pin 295 whose threaded distal end 297 is screwed into an opening 299 in the disk face 291.

Figure 9:
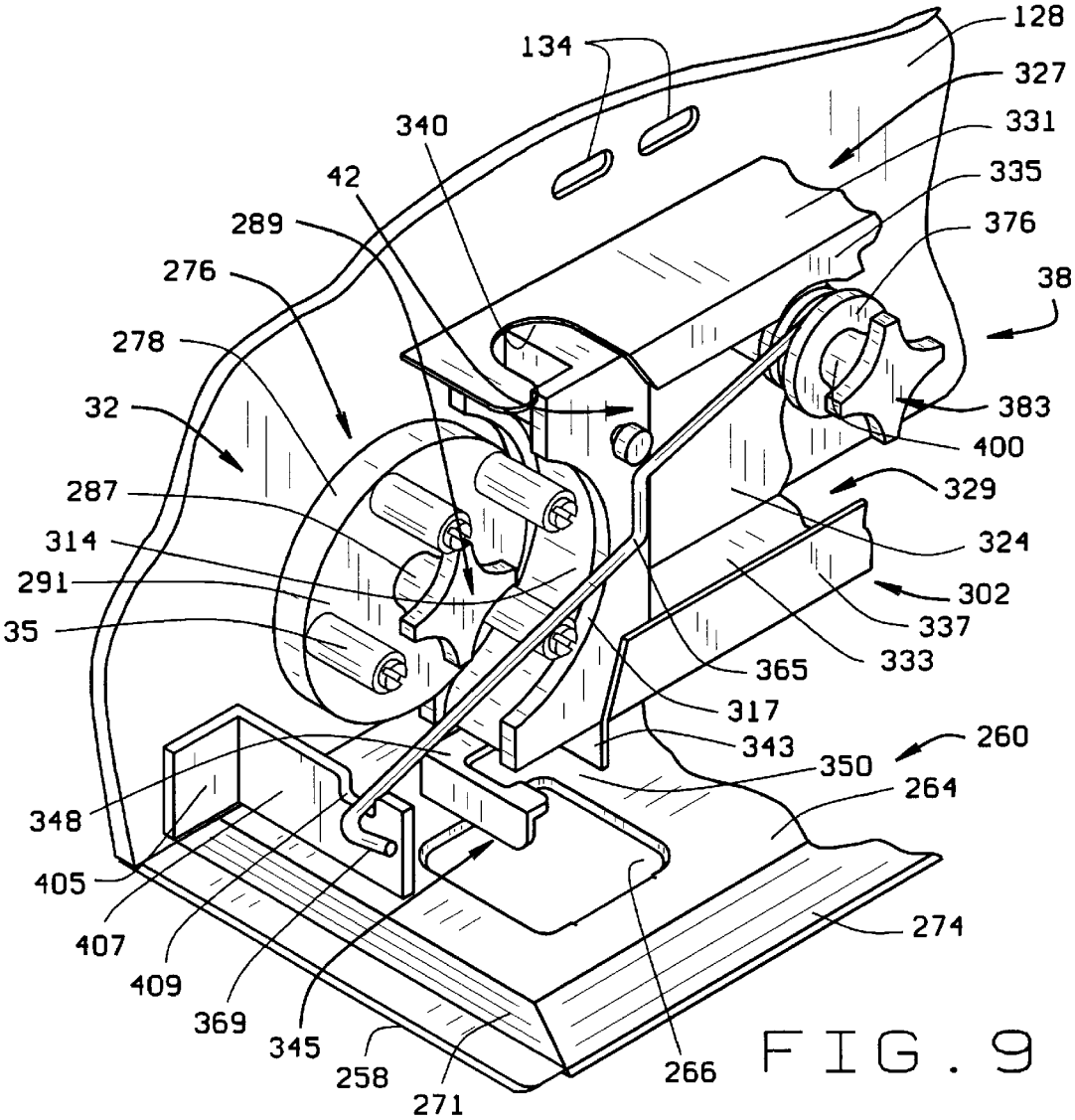
FIG. 9 is an enlarged view of part of the assembly of the invention, showing the means for applying force against the discharge tube in an assembled and engaged position.

Turning attention now to the means 38 for applying force against the discharge tube 24, and with particular reference to FIGS. 8 and 9, the assembly 20 has a pair of such means 38, each of which is associated with a discharge tube 24 and a pump head 276. A description of one means 38 is sufficient to describe the other. As noted in the Overall Description, each means 38 generally comprises the compression member 42 illustrated as a block which is slidably mounted on a track 302, and also comprises the means 46 for biasing the compression member 42 against the discharge tube 24 to press it against the pump pressure members 35.

The compression block 42 can be of plastic, such as of acetyl plastic, and formed by injection molding. The outer end of each block 42 has an arcuate recess 305. The radius of curvature of each recess 305 is approximately the same as or slightly larger than, the radius of curvature of the pump head disks 278. As seen more particularly in FIGS. 8 and 12, each block 42 has a slot in its outer edge which has a straight slot portion 307 that has a central flat end surface 309. Slot portion 307 extends downwardly into an arcuate slot portion 311 with a central arcuate curved surface 314. The block slot portions 307 and 311 have a width to receive the discharge tube 24 within the outer slot walls 317. A grip pin 319 has a threaded end that screws in to a hole in the block front face 320. The flat inner end 321 of block 42 can have molding recesses 322.

The track 302 can be of an integral stamped pressed sheet of stainless steel with a flat vertical section 324 which is secured so that its rear surface rests flush against the front surface of strut 128. Formed at the top and bottom of vertical section 324 are upper and lower channels 327 and 329, respectively, having respective horizontal sections 331 and 333. Sections 331 and 333 extend into vertical track side walls 335 and 337, respectively. The interior width of the channels 327 and 329 is slightly larger than the thickness of the compression block 42 so that block 42 slides horizontally within the track 302. At each end of upper track channel sections 331 is a frontwardly opening notch 340 whose front entrance has straight edges that extend into a semicircular inner edge. Notch 340 is sized to receive and maintain the discharge tube 24. At each end of the lower channel section 333 is a depending vertical flange 343. At the rear lower edge of flange 343 extends an "L" shaped discharge tube guide 345. Each guide 345 has a horizontal wall 348 that has a slot formed of a smaller entrance neck 350 that extends in to a larger closed end section 352. Neck 350 is sized to allow passage of discharge tube 24 therethrough into slot section 352 so that notch 340 and neck 350 and slot 350 hold discharge tube 24 in position to be engaged by the block 24. The outer edge of guide wall 348 has a depending leg 354.

Now attention is focused on the means 46 for biasing the compression block 42, which means 46 is part of the force applying means 38. The means 46 comprises the spring assembly 48. Assembly 48 comprises a spring 357, illustrated as a torsion spring, which is secured to the track 302. The torsion spring is the preferred spring, although other springs and biasing means such as resilient compression members, could be used. The spring has a helical trunk 359 from which extends a shorter leg 361 having a foot 363. Also extending from helical trunk 359 is a longer leg 365 having an angled knee 367 and a foot 369. Spring 357 is mounted to track 302 and to strut 128 by spring assembly 48 members comprising a bushing 372, a pair of washers 374 and 376, a bolt 378 and a knob 383. The bushing 372 has a cylindrical proximal section 385 that extends into an integral smaller distal section 387. The proximal bushing section 385 has a flat proximal end that fits flush against the flat front surface of track section 324. The washer 374 is located with its front surface flat against the flat rear surface of strut 128. The threaded end of bolt 378 extends through washer 374 through a hole 390 in strut 128 and through an aligned hole 392 in track section 324, and screws in a bore in the proximal surface of bushing section 385. The proximal bushing section 385 is of larger diameter than the internal diameter of helical spring body 359, so that the proximal end of helical body 359 rests against the middle annular shoulder 394 of bushing 372. The distal bushing section 387 is of slightly smaller diameter than the interior diameter of spring helical body 359 so that the helical body 359 can rotate thereabout. Distal bushing section 387 has a threaded bore 396 in its distal flat surface . The hand knob 383 has the same construction as knob 289. The threaded bolt 398 projecting from knob sleeve 400 passes through washer 376 and screws into bushing bore 396. The cylindrical knob sleeve 400 is of larger diameter than the bore of washer 376 so that the flat end surface of knob sleeve 400 presses against the front surface of washer 376 to press helical body 359 against bushing shoulder 394.

The spring assembly 46 comprises a means for engaging the spring 357 to hold it in a fixed biasing position. Said means comprises an L-shaped catch plate 403. Catch 403 has its base end 405 secured as by spot welding to the front surface of strut 128. A catch arm 407 extends from base 405 and has in its upper edge a rectangular notch 409.

To engage the spring 357, from the position shown for the block 42 and spring 357 to the left side of FIG. 5, the longer spring leg 365 is moved by the hand around the outer end of catch arm 407 above the upper edge of arm 407 to rest within notch 409, with the spring foot 369 extending beyond notch 409. As spring leg 365 is so moved, spring leg 361 is likewise pivoted so that spring foot 363 presses against the block end 321 to force block 42 against a mounted discharge tube 24, as shown for the block 42 to the right side of FIG. 5.

The aforedescribed detachable nature of components comprising the means 38 for applying force and its biasing means 46, allows for easy removal of such components from the housing 22. This allows the said components to be cleaned to remove cheese or other viscous food deposited thereon during operation, as well as any contaminants or other materials that have accumulated. Knob 290 can be easily unscrewed to remove the pump head 276. The screw pins 295 can be dismounted from the disks 278 so that the pressure member sleeves 293 can be removed. Likewise, the knob 232 can be unscrewed to allow removal of it as well as washer 376, spring 357 and bushing 372. With those components removed the compression block 42 can be slid toward the outer end of track 302 and removed from channels 327 and 329. The track 302 can also be secured to strut 128 by a nut and bolt passing through strut 128, so that track 302 can be easily removed for cleaning as well. After cleaning, the members can be easily reassembled for operation so that little down time occurs during such cleaning.

Because of the continual force applied by the biasing means 46 against compression member 42, manufacturing tolerances for the various components comprising the means 38 for applying force and the biasing means 46 do not have to be as close as would be necessary for an assembly wherein a force applying member is held in fixed position relative to a peristaltic pump head. For example, the space between the block 42 and the peristaltic pressure members 35 does not have to be machined to such tolerance as would be necessary with a fixed position relationship because the force applied by the spring 357 against the block 42 can overcome such tolerance variance to apply sufficient force against the block 42.

The constant pressure applied by the block 42 also allows for different size discharge tubes to be used with the assembly 20, with the biasing means 46 pressing the block 42 against the various sized discharge tubes with appropriate force against the peristaltic pressure members 35.

It can be seen that the assembly 20 provides multiple flow paths for the forced convection circulation of temperature regulated air. Arrows in FIG. 6 help to illustrate these flow paths. A first such path is from the motor/fan 57 by the temperature controlling means 51, and thence above the wall 124 and through its ports 126 to pass within the tube cover 260 as shown by the arrow going through cover 260 in FIG. 6. The first flow path then turns upwardly against the distal end of the discharge tube 24 thence along the discharge tube 24 to the front of the reservoir support 204 and thence above and between the retainer plates 228 and 230 and above and around the viscous food reservoir 22 to heat it or cool it as the case may be. The first flow path thence continues over the support rear wall 208 downwardly toward the circulation means 54, for recirculation.

A second flow path extends from the motor/fan 57 by the temperature control means 51 and thence toward the rear side of strut 128 through the strut ports 134 and 136 to pass over and between the reservoir retainer plates 228 and 230 and join the first flow path over and around the reservoir 22 and back toward the circulation means 51.

A third flow path extends from the motor/fan 57 by the temperature control means 51 upwardly along the underside of reservoir support floor wall 206 thence along the outside of reservoir support side walls sections 212 on through the side wall holes 216 and thence over the food reservoir 22 to join the first and second flow pathes in returning downwardly behind support rear wall 208 to the circulation means 54 fir recirculation.

To review more specifically the return flow path that extends behind the rear reservoir support wall 208, the beginning of the path is depicted by the downwardly extending arrow to the upper left of FIG. 6 to pass behind the motor mount wall angled section 198. The air then flows downwardly behind the lower motor mount wall section 192 and about and around the pump motor casings 241 to the rear of the motor/fan assembly 57, as shown by the curved arrow in the left corner of FIG. 6. From there, the air can be propelled by the motor/fan 57 through the fan duct in motor mount wall section 192, and thence again by the temperature control means 51 and on to be circulated through the described flow paths.

Figure 12:
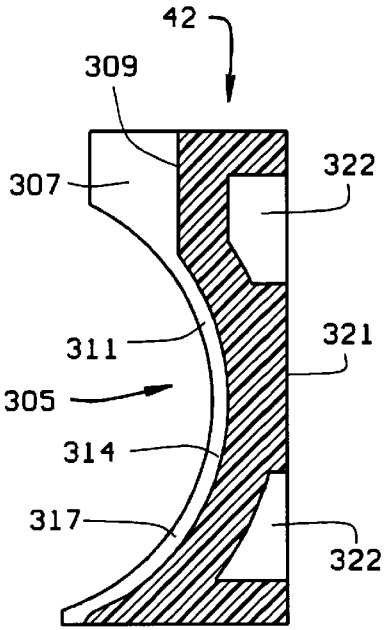
FIG. 12 is a section of the compression block, taken on the line 12—12 of FIG. 8.

The circuitry 412 for assembly 20 is illustrated in FIG. 12, with the same numerals being used for the fan/motor assembly 57, pump motors 233, pump switches 180 and 181, safety switch 182, heating element 52 and thermostat 244 to show the electrical connection among them, and with electrical connection with a plug 414. The safety switch 182 is connected to the pump switches 180 and 181 so that the pumps 233 are inoperable when the cover 160 is pivoted to the open to release the force of cover 160 against the safety switch 182. Placing the power switch 121 to the "on" position energizes the heating element 52 and powers the fan/motor assembly 57 to blow heated air as heretofore described.

In operation, the cover 160 can be pivoted open and reservoirs of viscous food 22 can be positioned within the reservoir support 204 on either side thereof as illustrated for one reservoir 22 in FIG. 5. With the compression block 42 slid away from its corresponding pump head 276 such as illustrated for the pump head 276 to the left side of FIG. 5, the discharge tube 24 can be installed. The discharge tube 24 can be connected to the reservoir outlet 225 which outlet can have a fitting that is located to rest on the upper track wall 331, so that the discharge tube fits within the notch 340 in wall 331. The discharge tube 24 can then be extended along side the pump head 276 to pass through the neck 350 into the slot section 352 at the lower end of the track. With the discharge tube so positioned, the operator can by hand grasp the grip pin 319 and move block 42 toward pump head 276.

The operator can then grasp the longer spring leg 365 and pivot it upwardly to fit within the catch notch 409 so that the spring 357 and block 42 have the position relative to the discharge tube 24 and pump head 276 as illustrated on the right side of FIG. 5. The tube cover 260 can be mounted as shown in FIGS. 2, 3, 6 and 9 so that the distal end of the discharge tube is located to be aligned with tube cover opening 266. The cover 160 can be pivoted to the closed position. The circuitry 412 can then be operated as heretofore described to activate the fan/motor assembly 57 and the heating element 52 so that heated air is circulated throughout the housing in the manner heretofore described to heat the reservoir 22, and the discharge tube 24 including its distal end. The peristaltic pumps 233 can be activated by the pump switches 180 and 181 so that both pumps operate at the same time, if desired, to force viscous food from reservoirs 22 through the discharge tubes 24 and through the tube cover opening 266 on to a plate or container positioned therebeneath within the exterior housing recess 72.

After operation, the assembly can be cleaned by removing the pump heads 276 as described. With pump head 276 removed, its corresponding block 42 can be slid to be removed from the track 302. The knobs 382 can be disengaged as described, to allow removal of the springs 357 and washers 376. All the removed components can be cleaned and then easily remounted once again.

Different size discharge tubes 24 can be mounted as described and the compression block 42 with the force applied by the biasing means 46 will apply the appropriate amount of pressure for discharge of viscous food through the tube 24. As noted earlier, because of the design, the tolerances for the various components can be greater than with prior designs.

The various walls of box 60, except for the floor and rear walls; the cover insulation walls 174 and 176; reservoir support 204, track 302, pins 295, springs, washers, shafts, tube cover, drip tray and casings can be of stainless steel. The insulation walls 98, 100 and 148, the motor mount wall 190, floor wall 64, and rear wall 94 can be of aluminized steel. The shafts 236, disks 278 and bushings 372 can be of aluminum.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. In an assembly for dispensing viscous food products such as melted cheese, mustard, ketchup, sour cream or the like, wherein a discharge tube having a distal end with an outlet for discharging viscous food products is connected to a reservoir of viscous food product:

(a) a housing;

(b) a peristaltic pump comprising a pump head with pressure members, said pump mounted in association with the housing so that the pump head can rotate relative to the housing, and means associated with the housing for allowing the discharge tube to be positioned to extend along the peristaltic pump head;

(c) means for providing support for the reservoir of viscous food;

(d) means for applying force against the discharge tube to press the discharge tube against the pressure members of the peristaltic pump head as the pressure members are rotated relative to the housing to allow viscous food product to be pumped from the said reservoir through the discharge tube, said means comprising a compression member movably mounted in association with the housing, and means for biasing the compression member against the discharge tube to press it against the pressure members of the pump head as the pump head rotates.

2. In the assembly for dispensing viscous food of claim 1, wherein the means for applying force against the discharge tube comprises means for movably mounting the compression member relative to the housing, said movably mounting means comprising a track mounted to the housing, and wherein the compression member is slidably mounted relative to the track.

3. In the assembly for dispensing viscous food of claim 1, wherein the compression member comprises a block, the block comprising a notched section of an arcuate shape for fitting about the pump head, and the notched part of the block head having a slot sized to receive the discharge tube.

4. In the assembly for dispensing viscous food of claim 1, wherein the means for biasing the compression member comprises a spring mounted in association with the housing, a catch mounted to the housing, the spring having a portion for engagement with the catch to be held in fixed position relative to the catch, and the spring having another portion for engaging the compression member to force it towards the pump head of the peristaltic pump.

5. In the assembly for dispensing of viscous food of claim 4, wherein the spring is a torsion spring that comprises a helical section and wherein the spring portion that engages the catch comprises a first leg extending from the helical section, and wherein the portion of the spring that engages the compression member comprises a second spring leg that extends from the spring helical section.

6. In the assembly for dispensing viscous food of claim 4, wherein the housing has a strut for supporting the pump head, the strut having a front side, a track for slidably mounting the compression member, said track being mounted to the front side of the strut; the spring being mounted to the front side of the strut and the spring catch being mounted to the front side of the strut; with means for mounting and dismounting the spring so that the spring can be disengaged from the strut, from the catch and from the compression member.

7. In the assembly for dispensing viscous food of claim 6, wherein the track has an upper channel section and lower channel section, and wherein the width of said channel sections is slightly larger than the thickness of the compression member so that the compression member slides within the side upper and lower channel sections.

8. In the assembly for dispensing viscous food of claim 6, wherein the track has an upper wall, said wall having a notch sized the receive the discharge tube, and the track having a lower section, said lower section having a slot sized to receive the discharge tube, so that the said track notch and track slot help to hold the discharge tube in a fixed position so that the compression block can be moved to engage the discharge tube.

9. In the assembly for dispensing viscous food of claim 6, further comprising a bushing for mounting the spring, the bushing being secured to the front side of the strut, the bushing having a proximal section and a distal section, the distal section having a smaller diameter than the proximal section, the diameter of the distal bushing section being smaller than the diameter of the helical section of the spring, and the proximal bushing section having a diameter greater than the interior diameter of the helical section of the spring, so that the spring can be mounted with the helical section fitting about the distal bushing section and resting against the proximal bushing section.

10. In the assembly for dispensing viscous food of claim 9, the track having a front side, the bushing being mounted toward the front side of the track, with means for engaging and disengaging the bushing and spring from the track.

11. In the assembly for dispensing viscous food of claim 10, wherein the means for engaging and disengaging the bushing and spring comprises the distal section of the bushing having a bore, and a grippable knob having means for engaging the bore in the distal bushing section so that the spring is held between the bushing and the knob in secured position.

12. In the assembly for dispensing viscous food of claim 3, wherein the compression block has a notched section of generally straight shape, said straight notched section being positioned above the said arcuate notched section and extending into the archuate notched section.

13. In the assembly for dispensing viscous food of claim 6, wherein the strut has ventilation ports extending through it to allow passage of air from the rear side of the strut to the front side of the strut.

14. In an assembly for dispensing viscous food such as melted cheese, mustard, ketchup, sour cream or the like, wherein a discharge tube having a distal end with an outlet for discharging viscous food products is connected to a reservoir of viscous food product:

(a) a housing, the housing having means for being enclosed;

(b) a peristaltic pump comprising a pump head with pressure members, said pump mounted in association with the housing so that the pump head can rotate relative to the housing, and means associated with the housing for allowing the discharge tube to be positioned to extend along the peristaltic pump head;

(c) means for providing support for the reservoir of viscous food products, said reservoir support means having a bottom, a front and sides;

(d) the housing having a means for controlling the temperature of air circulated throughout the assembly, and a means for forcing circulation of the temperature controlled air within the enclosed part of the housing; and flow paths within the housing for circulating the temperature controlled air, the housing having structure providing means for establishing flow of temperature controlled air about the distal end of the discharge tube and alongside the discharge tube and thence in front of the reservoir support and over the top of the reservoir of viscous food supported by the reservoir support and then to return to the means for forcing circulation; and the housing having structure further providing means for establishing a flow path from the air temperature controlling means to travel along the bottom of the reservoir support and thence along the sides of the reservoir support, and thence return to the means for forcing circulation of the temperature controlled air.

15. In the assembly for dispensing viscous foods of claim 14, wherein the housing comprises a mount member to which the peristaltic pump head is mounted, said flow path within the housing comprising said pump support member having openings therethrough to allow flow of temperature controlled air from the means for controlling air temperature through the said openings in the pump support member, thence along the front of said reservoir support and over the reservoir of food in the reservoir support and thence return to the means for controlling the air temperature.

16. In the assembly for dispensing viscous foods of claim 14, wherein the housing comprises a tube cover portion, and wherein the flow path of temperature controlled air about the distal end of the discharge tube and comprises a flow path through the tube cover.

17. In the assembly for dispensing viscous foods of claim 16 wherein the tube cover is detachably mounted from other parts of the housing, and wherein the tube cover has an opening for allowing dispensing of viscous food from the discharge tube.

18. In the assembly for dispensing viscous food of claim 14, wherein the housing has side walls with interior surfaces, the housing structure for establishing flow of temperature controlled air comprises the reservoir support side walls being positioned to be spaced from the interior surfaces of the housing side walls, wherein the said reservoir support side walls have extensions for mounting to the interior side walls of the housing, and the side walls having openings near their top so that temperature controlled air can flow upwardly along the sides of the reservoir support side walls and through the openings and thence return to the means for forcing air circulation.

19. In the assembly for dispensing viscous food of claim 14, wherein the housing structure that provides means for establishing flow of air comprises an intermediate wall mounted within the housing enclosure, the intermediate wall having a front side and a rear side, the wall having an opening for allowing the passage of air by the means for forcing circulation of air with the said forced circulation means mounted to the intermediate wall about said opening in the intermediate wall, the intermediate wall having an upper end that mounts the reservoir support, so that air flowing over the reservoir and the reservoir support member can flow to the rear side of the intermediate wall, and wherein the means for controlling the temperature of air is positioned to the front side of the said intermediate wall.

20. In the assembly for dispensing viscous food of claim 19, wherein the peristaltic pump has a motor and a drive shaft, and wherein the pump motor is mounted to the rear side of the intermediate wall above the means for forcing circulation, and wherein the pump drive shaft extends toward the front side of the intermediate wall to be connected to the pump head.

21. In an assembly for dispensing viscous food products such as melted cheese, mustard, ketchup, sour cream or the like, wherein a discharge tube having a distal end with an outlet for discharging viscous food products is connected to a reservoir of viscous food product:

(a) a housing, the housing having a support strut, the strut having a front and rear side;

(b) a peristaltic pump comprising a pump head with pressure members, said pump mounted in association with the housing so that the pump head is mounted to the front side of the strut so that the pump head can rotate relative to the housing, and means associated with the housing for allowing the discharge tube to be positioned to extend along the peristaltic pump head;

(c) means for providing support for the reservoir of viscous food;

(d) means for applying force against the discharge tube to press the discharge tube against the pressure members of the peristaltic pump as pressure members are rotated relative to the housing to allow viscous food product to be pumped from the said reservoir through the discharge tube, said forcing means comprising a compression member movably mounted on a trackattached to the front side of the strut and said force means comprising means for biasing the compression member against the discharge tube to press it against the pressure members of the pump head as the pump head rotates, said means for biasing comprising a spring mounted to the front side of the strut, a catch mounted to the strut, the spring having a portion for engagement with the catch, and the spring having another portion for engaging the compression member to force it towards the pump head of the peristaltic pump, and means for engaging and disengaging the compression member and the spring to and from the housing strut.

22. In an assembly for dispensing viscous food such as melted cheese, mustard, ketchup, sour cream or the like, wherein a discharge tube having a distal end with an outlet for discharging viscous food products is connected to a reservoir of viscous food product:

(a) a housing, the housing having means for being enclosed, the housing having a strut with a front side and a rear side, and the housing comprising side insulation walls with interior surfaces;

(b) a peristaltic pump comprising a pump head with pressure members, said pump mounted in association with the housing so that the pump head is mounted to the front side of the strut so that the pump head can rotate relative to the strut, and means associated with the housing for allowing the discharge tube to be positioned to extend along the peristaltic pump head;

(c) means for providing support for the reservoir of viscous food products, said reservoir support means having a bottom, a front, a rear and sides;

(d) the housing having a means for controlling the temperature of air circulated throughout the assembly, (e) means for forcing circulation of the temperature controlled air within the housing; and means for providing structure establishing flow paths within the housing for circulating the temperature controlled air about the distal end of the discharge tube, alongside the discharge tube and about the reservoir support and then to return to the means for forcing circulation; the flow path means comprising a tube cover portion detachably mounted to the rest of the housing and wherein the flow path of temperature controlled air about the distal end of the discharge tube, and along side the discharge tube comprises a flow path through the tube cover; said flow path means further comprising said strut having openings therethrough to allow flow of air from the forced circulation means from the rear side of the strut through the said strut openings to the front side of the strut and thence along the discharge tube and thence along the front of said reservoir support and over the reservoir of food in the reservoir support and thence return to the means for forcing circulation; the flow path means also comprising structure for establishing a flow path from the forced circulation means to travel along the bottom of the reservoir support and thence along the sides of the reservoir support, and thence return to the means for forcing circulation, comprising the reservoir support sides being spaced from the interior surfaces of the housing side insulation walls, so that forced circulation of temperature controlled air can flow upwardly along the reservoir support sides and thence return to the means for forcing air circulation; and the flow path means also comprising an intermediate wall mounted within the housing, the intermediate wall having a front side and a rear side, the intermediate wall having an opening for allowing the passage of air by the means for forcing circulation with the said forced circulation means mounted to the intermediate wall about said intermediate wall opening, so that air flowing over the reservoir and the reservoir support can flow to the rear side of the intermediate wall toward the forced circulation means; and wherein the means for controlling the temperature of air is positioned to the front side of the said intermediate wall.

23. A method for dispensing viscous food products such as melted cheese, mustard, ketchup, sour cream or the like, comprising the steps of:

a) providing a housing, and placing a reservoir of viscous food within the housing to be supported thereby;

b) providing a peristaltic pump with a pump head and pressure members, the pump head mounted to rotate relative to the housing;

c) providing a compression member mounted to the housing to move relative to the housing;

d) providing a means for biasing the compression member in a direction toward the pump head, and a means to engage part of the biasing means relative to the housing;

e) providing a discharge tube with a distal end, and connecting the discharge tube to the viscous food reservoir so that the viscous food can flow through the discharge tube, and positioning the discharge tube between the peristaltic pump and the compression member;

f) engaging the biasing means so that the biasing means applies force against the compression block, to force the compression block against the discharge tube and thereby force the discharge tube against the peristaltic pump head pressure members; and g) rotating the peristaltic pump head to force viscous food through the discharge tube and out of the distal end of the discharge tube.

24. A method for dispensing viscous food products such as melted cheese, mustard, ketchup, sour cream or the like, comprising the steps of:

a) providing a housing with a support for supporting the reservoir of viscous food;

b) providing a peristaltic pump comprising a pump head with pressure members, mounted in association with the housing so that the pump head can rotate relative to the housing;

c) providing a means for controlling the temperature of air within the housing;

d) providing a means for circulating temperature controlled air throughout the housing;

e) providing a flow path for temperature controlled air to circulate along the distal end of the discharge tube and alongside the discharge charge tube and thence above the reservoir of viscous food and thence to the means for circulating air;

f) providing a flow path for the flow of temperature controlled air along the bottom of the support for the reservoir of viscous food and thence along the sides of the said reservoir support and thence to the means for circulating air.

25. The method for dispensing viscous food of claim 24, further providing a support strut having a front side and a rear side, with the pump head mounted toward the front side of the strut, providing the strut with passageways therethrough for circulation of air, and circulating temperature controlled air from the rear side of the strut through the passageway to the front side of the strut and thence upwardly in front of the reservoir of food and thence over the food reservoir and to the means for circulating air.

* * * * *